US005966853A

United States Patent [19]

Yeh

[11] Patent Number: 5,966,853

[45] Date of Patent: Oct. 19, 1999

[54] CHRISTMAS TREE MOVING MECHANISM

[76] Inventor: Chun I Yeh, 4Fl., No. 36-2, Lane 150, Ming Te Rd., Taipei, Taiwan

[21] Appl. No.: 09/145,986

[22] Filed: Sep. 3, 1998

[51] Int. Cl.[6] ..... G09F 19/08; A63H 3/36; A63H 3/40

[52] U.S. Cl. ..... 40/416; 446/337; 446/342

[58] Field of Search ..... 40/411, 414, 416; 446/342, 343, 345, 337

[56] References Cited

U.S. PATENT DOCUMENTS

| | | | |
|---|---|---|---|
| 2,871,593 | 2/1959 | Roberts | 40/416 X |
| 4,402,158 | 9/1983 | Seki et al. | 446/343 X |
| 4,869,703 | 9/1989 | Ong | 40/414 X |
| 5,458,525 | 10/1995 | How | 40/414 X |
| 5,855,502 | 1/1999 | Truchsess | 446/343 X |
| 5,870,842 | 2/1999 | Ogden et al. | 40/414 X |

*Primary Examiner*—Brian K. Green
*Assistant Examiner*—Marcus Dolce
*Attorney, Agent, or Firm*—Bacon & Thomas, PLLC

[57] ABSTRACT

The invention relates to a movable Christmas tree moving mechanism, particularly to one comprising a foundation, a connecting rod set, a U-shaped support, a cover plate, a mouth movement and an eye movement, whereby the coordination of an overlapped round cam on the foundation, and a short rod, low rod and a high rod in the connecting rod set, along with the configuration of a moving block of a U-shaped support, a mouth movement and an eye movement enables the movement of the jaw, eyes and head on a toy face.

1 Claim, 9 Drawing Sheets

CHRISTMAS TREE MOVING MECHANISM

BACKGROUND OF INVENTION

This invention relates to a Christmas tree moving mechanism, particularly to one with the combination of an overlapped round cam and other components, to move the jaw, eyes and head that are built in the Christmas tree.

Conventional Christmas trees do not involve any moving component. Some may involve a movable Christmas tree mechanism, which produce merely regional and intermittent movement, instead of steady and continued movement of the Christmas tree; once people got tired or lost their novel feeling of the conventional type of movement in such a Christmas tree, it will no longer attract their attention; ordinary decorative items or toys lack attracting movement or simultaneous or intermittent movement of multiple components which will attract people's attention.

In view of this, the inventor has devoted in the research, based on several years of experience in the sales, production and design of toys and gifts, and has developed a novelty Christmas tree moving mechanism that is quite different from the moving styles in conventional Christmas trees, with exaggerated effects of movement in various components to bring fun to the doll, moreover, its mechanical movement will ensure accurate operation and durable construction of the doll. This application is filed for a patent. Your favorable consideration will be appreciated.

SUMMARY OF INVENTION

The primary objective of the present invention is to design a mechanically driven and movable Christmas tree moving mechanism, enabling exaggerated movement of a jaw, eyes and head components that are built in the Christmas tree.

This invention comprises a foundation, a connecting rod set, a U-shaped support, a cover plate, a mouth movement and an eye movement, wherein: a transmission shaft on a foundation in coordination with an overlapped round cam will enable two slide blocks to slide smoothly up and down in a first step slide rail, with the combination of a short rod involving a jaw pushing rod, and two rods, one high and one low, which include a connector, an upper and a lower eye pushing rods and a transverse groove hole, and two slide blocks; then, a round protrusion of the U-shaped support is connected with the moving block, then the short rod, high and low rods of the connecting rod set are fixed by the cover plate to the second step slide groove of the U-shaped support, finally, the mouth movement and the eye movement are installed onto the cover plate, the jaw moving rod of the mouth movement is installed on the jaw pushing rod, the eye moving rod of the eye movement is installed between the upper and lower eye pushing rods, thus a Christmas tree with built-in jaw, eyelids and head is configured to make exaggerated movement.

Brief Description of Numerals

Figure 1:
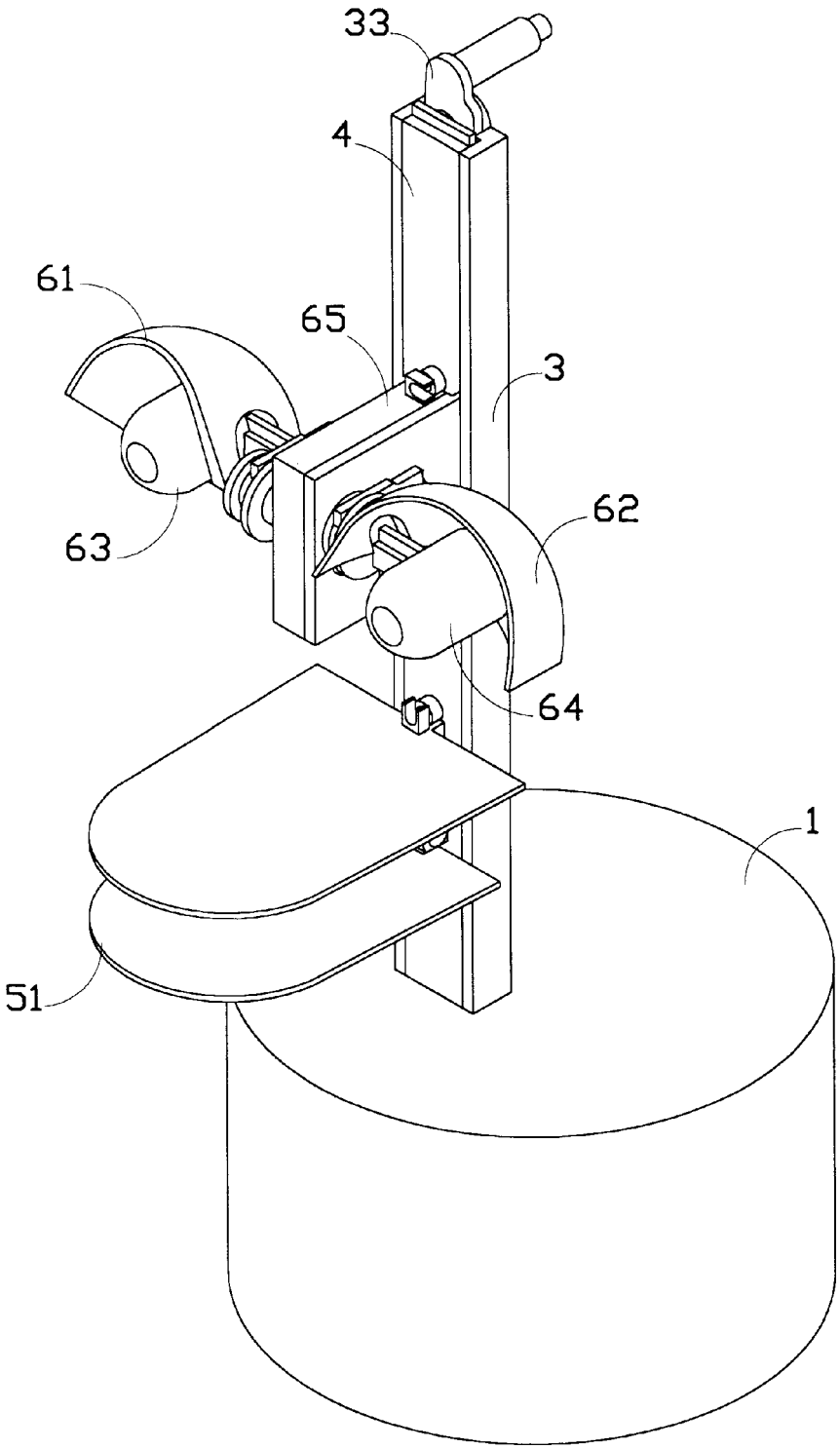
FIG. 1 is a perspective assembled view of the invention.
Figure 2:
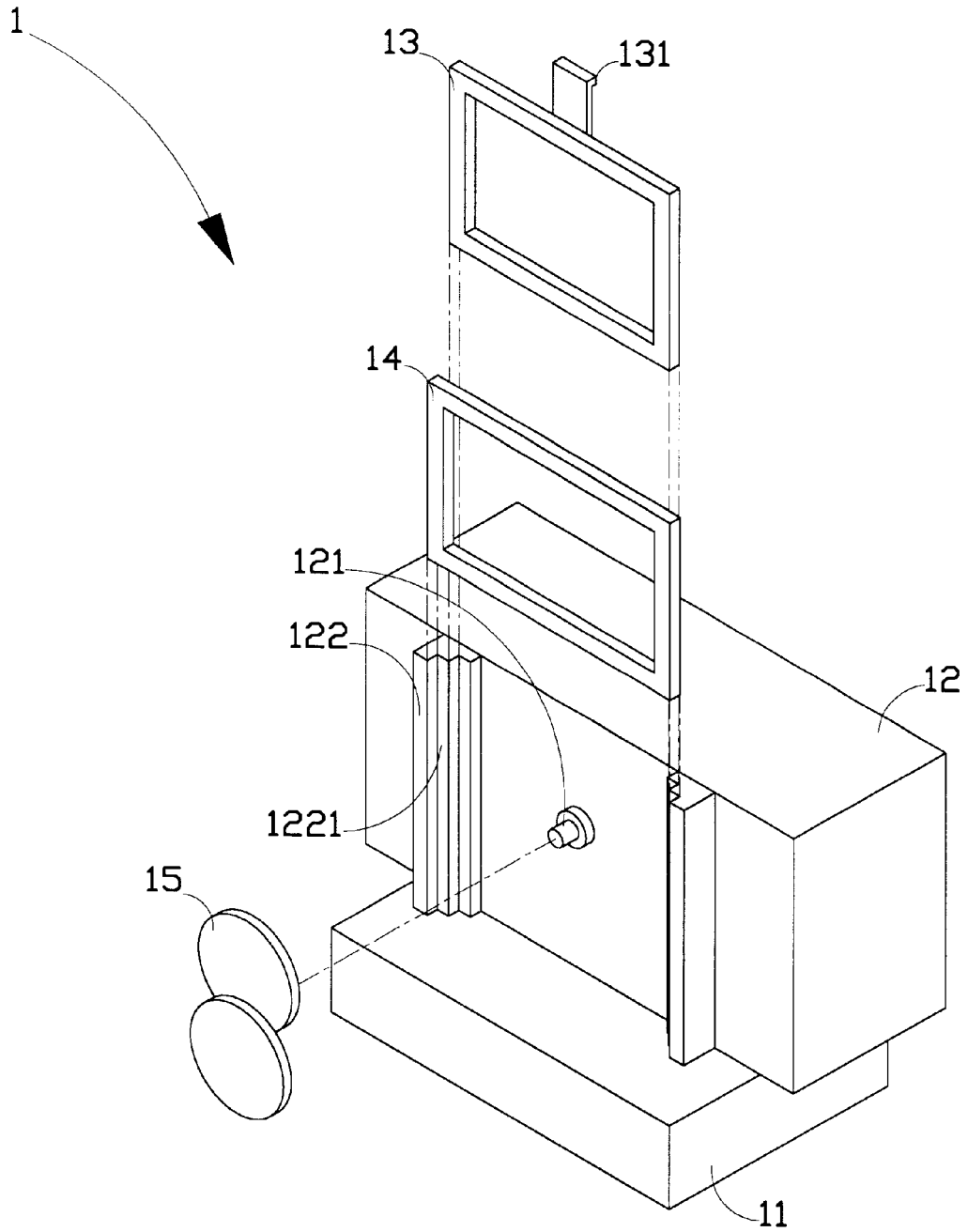
FIG. 2 is an exploded view of the invention (1).
Figure 3:
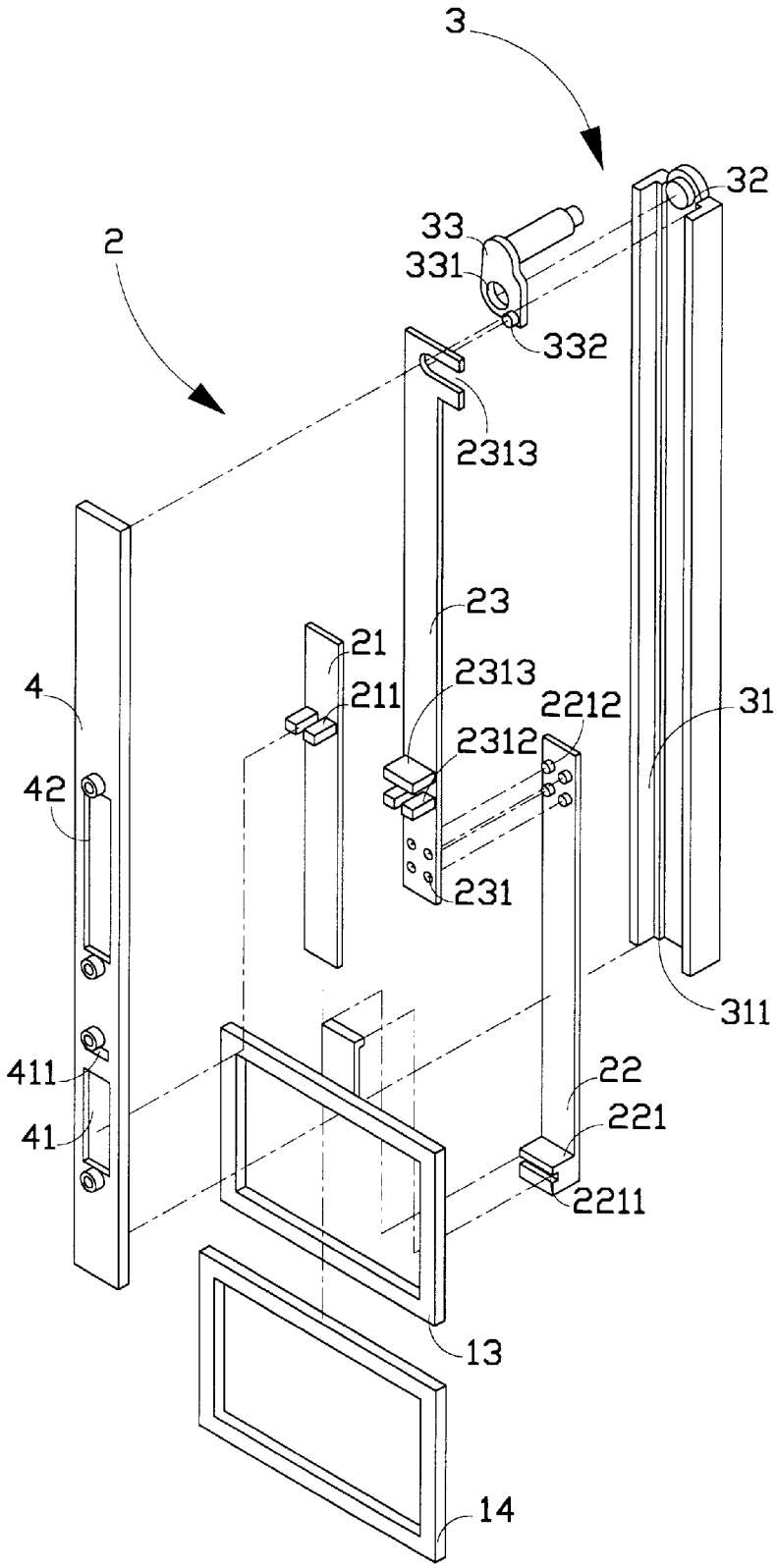
FIG. 3 is an exploded view of the invention (2).
Figure 4:
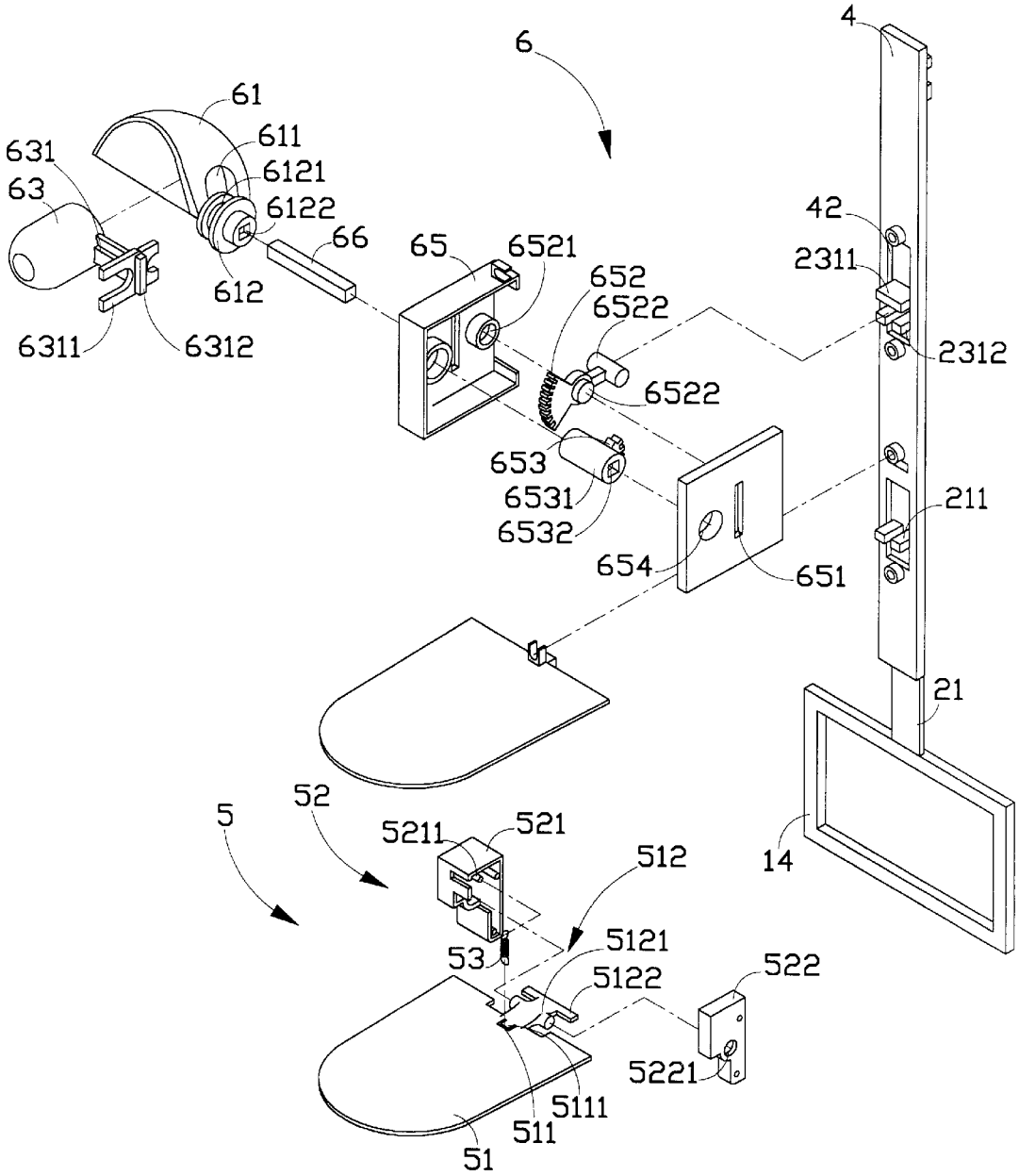
FIG. 4 is an exploded view of the invention (3).

| | | | |
|---|---|---|---|
| 1 | foundation | 11 | battery box |
| 12 | gear box | 121 | transmission shaft |
| 122 | guide lever | 1221 | first step slide rail |
| 13 | inner slide block | 131 | male hook |
| 14 | outer slide block | 15 | overlapped round cam |
| 2 | connecting rod set | 21 | short rod |
| 211 | jaw pushing rod | 22 | low rod |
| 221 | connector | 2211 | hook groove |
| 2212 | jutting key | 23 | high rod |
| 231 | through hole | 2311 | upper eye pushing rod |
| 2312 | lower eye pushing rod | 2313 | transverse groove hole |
| 3 | U-shaped support | 31 | arm |
| 311 | second step slide rail | 32 | round block |
| 33 | moving block | 331 | shaft hole |
| 332 | turning block | 4 | cover plate |
| 41 | jaw pushing rod operating outlet | 42 | eye pushing rod operating outlet |
| 5 | mouth movement | 51 | jaw |
| 511 | C-shaped hole | 5111 | hook plate |
| 512 | jaw protruding block | 5121 | jaw rotating shaft |
| 5122 | jaw moving rod | 52 | jaw box |
| 521 | left cover | 5211 | fixing bolt |
| 53 | fixing spring | 6 | eye movement |
| 61 | left eye cap | 611 | eye fixing hole |
| 612 | eye cap shaft block | 6121 | clasp groove |
| 6122 | shaft rod insert groove | 62 | right eye cap |
| 63 | left eye cap | 631 | clasp part |
| 6311 | U-shaped clasp | 6312 | protruding rib |
| 64 | right eye | 65 | eye moving box |
| 651 | slot | 652 | fan gear 1 |
| 6521 | joining shaft groove | 6522 | eye moving rod |
| 653 | fan gear 2 | 6531 | shaft cylinder |
| 6532 | shaft rod hole | 654 | shaft hole |
| 66 | shaft rod | 7 | camouflage part |

DETAILED DESCRIPTION OF PREFERRED EMBODIMENT

As illustrated in FIGS. 1 to 4, this invention comprises a foundation (1), a (connecting rod set (2), a U-shaped support (3), a cover plate (4), a mouth movement (5) and an eye movement (6), wherein on the foundation (1) is a battery box (11) and a gear box (12), extending from said gear box (12) is a transmission shaft (121), on two sides of the transmission shaft (121) are two guide levers (122), in each of the two guide levers (122) is a first step slide rail (1221) that corresponds to the inner and outer slide blocks (13) (14), protruding from the inner slide block (13) is a male hook (131), fixed to the transmission shaft (121) is an overlapped round cam (15), so configured that the inner and outside slide blocks (13) (14) will respectively move up and down smoothly within the first step slide rail (1221) while the overlapped round cam (15) is rotating; at an appropriate location on a short rod (22) of the connecting rod set (2) is fitted a jaw pushing rod (211), a low rod (22) fitted with a connector (221), on the connector (221) corresponding to the male hook (131) of the inner slide block (13) is a hook groove (2211), at the top of the low rod (22) are no less than two jutting keys (2212), on the high rod (23) corresponding to the jutting keys (2212) on the low rod (22) are a same number of through holes (231), at appropriate locations on the high rod (23) are two eye pushing rods (2311) (2312) positioned one on top of the other and a transverse groove hole (2313); on two arms (31) of the U-shaped support (3) is a matching second step slide groove (311), said second step slide groove (311) enabling respective up-and-down sliding of the short rod (21), the low rod (22) connected by multiple keys and the high rod (23), on the top of the U-shaped support (3) is a round block (32), said round block

(32) to be matched with a shaft hole (331) on a moving part (33), next to the shaft hole (331) on the moving part (33) is an eccentric turning block (332) to match the transverse groove hole (2313) on the high rod (23); on the cover plate (4) corresponding to the jaw pushing rod (211) and the two eye pushing rods (2311) (2312) are respectively a jaw pushing rod operating outlet (41) and an eye pushing rod operating outlet (42); at the jaw (51) of the mouth movement (5) is a C-shaped hole (511), said C-shaped hole (511) enables the extension of a hook plate (5111) from the jaw (51), the jaw (51) extends backwards to form a jaw protrusion (512), a jaw turning shaft hole (5221) in the jaw box (52) supporting the jaw turning shaft (5121) of said jaw protrusion (512), while the jaw moving rod (5122) of the jaw protrusion (512) penetrates the jaw box (52) to be mounted onto the jaw pushing rod (211) on the short rod (21) of the connecting rod set (2), and, there being a fixing bolt (5211) in the jaw box (52) that is composed of two side covers (521) (522) on the left and right, the two ends of the fixing spring (53) are respectively fixed to the hook plate (5111) in the C-shaped hole (511) and the fixing bolt (5211) of the jaw box (52); arranged symmetrically inside two eye caps (61) (62) of the eye movement (6) are an eye fixing hole (611) and an eye cap shaft block (612), in the depression of the eye cap shaft block (612) of the two eye caps (61) (62) is respectively a ring clasping groove (6121), on the ends opposite to each other of said two eye cap shaft blocks (612) are shaft rod insert grooves (6122) arranged symmetrically, the two eye parts (63) (64) penetrate the eye cap fixing hole (611) of the two eye caps (61) (62) and extend to include a clasp part (631), at the end of said clasp part (631) is a U-shaped clasp (6311) to clasp the clasp groove (6121) of the eye cap shaft block (612), while a protruding rib (6312) on the clasp part (631) is inserted in the slot (651) of the eye moving box (65), inside said eye moving box (65) is movably connected with two toothed fan gears (652) (653), while the first fan gear (652) is connected to the connecting shaft groove (6521) of the eye moving box (65), it extends backward to form an eye moving rod (6522), said eye moving rod (6522) being located between two eye pushing rod (2311) (2312) that are arranged one on top of the other, the second fan gear (653) has a shaft (6531) that protrudes to the shaft hole of the eye cap (65), on the shaft (6531) corresponding to the shaft rod (66) is a shaft rod hole (6532), so designed that the shaft rod (66) will be connected with the shaft rod insert groove (6122) of the two eye caps (61) (62) by means of said shaft rod hole (6532); the outer slide block (14) in the foundation (1) is placed to the bottom of the short rod (21), the male hook (131) of the inner slide block (13) is placed on the hook groove (2211) of the low rod (22), then the cover plate (4) is covered onto the second step slide groove (311) and the moving block (33) of the U-shaped support (3), then, the eye movement (6) and the mouth movement (5) are fixed onto the cover plate (4).

Figure 5:
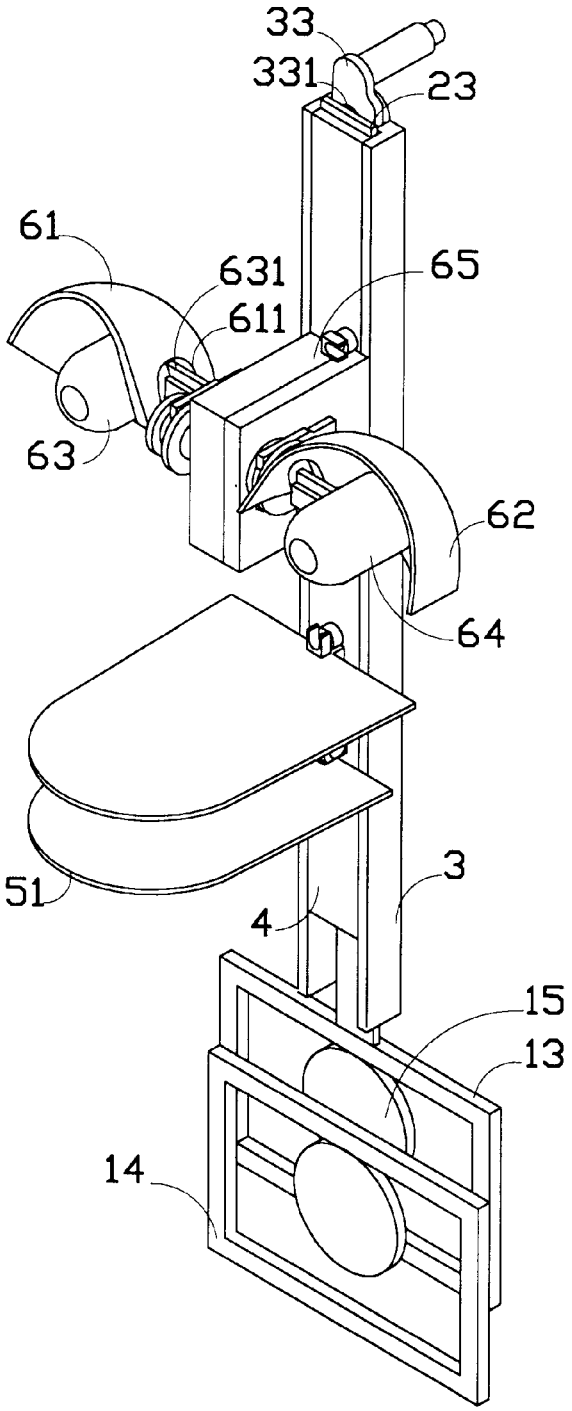
FIG. 5 is a structural assembled view of the invention.

As illustrated in FIG. 5, this invention is featured in that, when the overlapped round cam (15) is rotating, the resultant vertical height difference will create a vertical height difference to the inner and outer slide blocks (13) (14), and each independently moves up and down in the first step slide rail (1221), so the short rod (21) and the low rod (22) move up and down accordingly, which in turn drives the connecting rod set (2), the moving block (33), the mouth movement (5) and the eye movement (6) to move accordingly.

Figure 6:
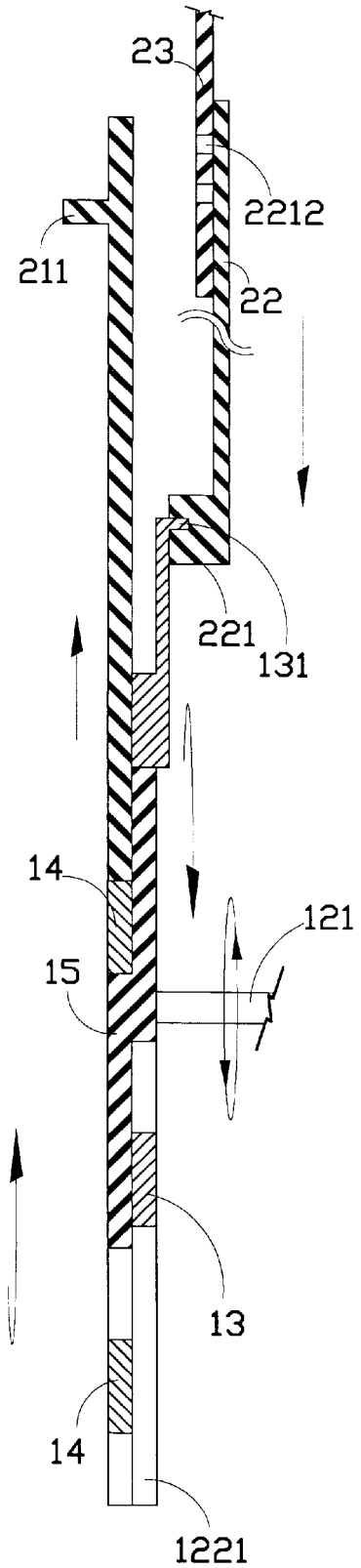
FIG. 6 is a view of the invention in action (1).
Figure 7:
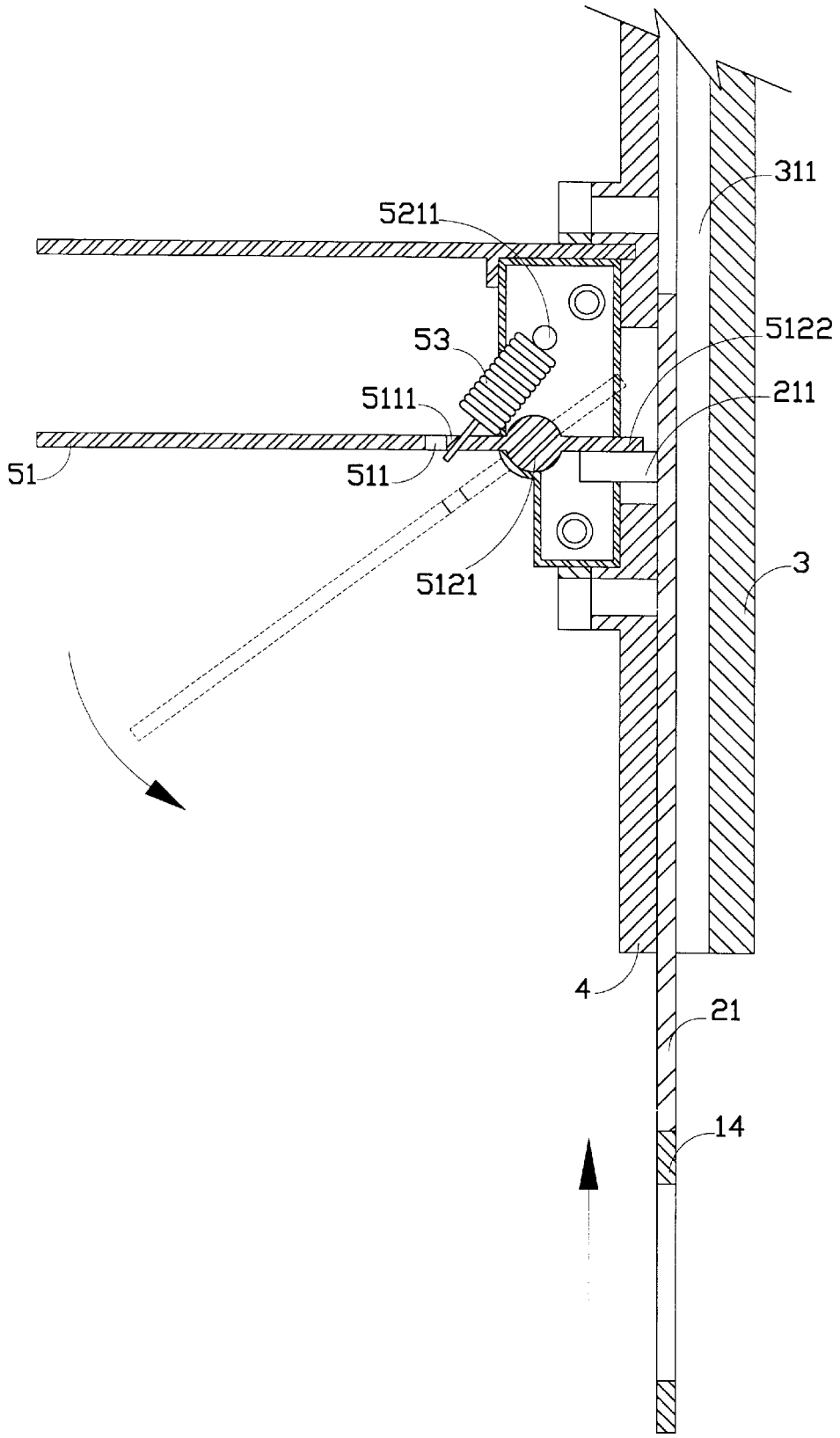
FIG. 7 is a view of the invention in action (2).

As illustrated in FIGS. 6 and 7, in the mouth movement (5), the jaw moving rod (5122) of the jaw (51) is positioned on the jaw pushing rod (211) of the short rod (21), he fixing bolt (5211) of the jaw box (52) and the hook plate (5111) of the jaw (51) are jointly hooked by a fixing spring (53); when the outer slide block (14) pushes the short rod (21) upward, the jaw pushing rod (211) will push the jaw moving rod (5122) upward, then the jaw (51) will be opened downward with the jaw turning shaft (5121) serving as an axis; meanwhile, the fixing spring (53) is stretched, so when the outer slide block (14) has not pushed up the short rod (21), the resiliency of the fixing spring (53) will restore the jaw (51) to a normal status; therefore, this invention requires no additional connecting device between the short rod (21) and the outer slide block (14); likewise, since there is no component similar to the fixing spring (53) on the eye movement (6), it requires a connecting component similar to the male hook (131) and the hook groove (2211) between the low rod (22) and the inner slide block (13), to ensure the connection between the male hook (131) and the hook groove (2211).

Figure 8:
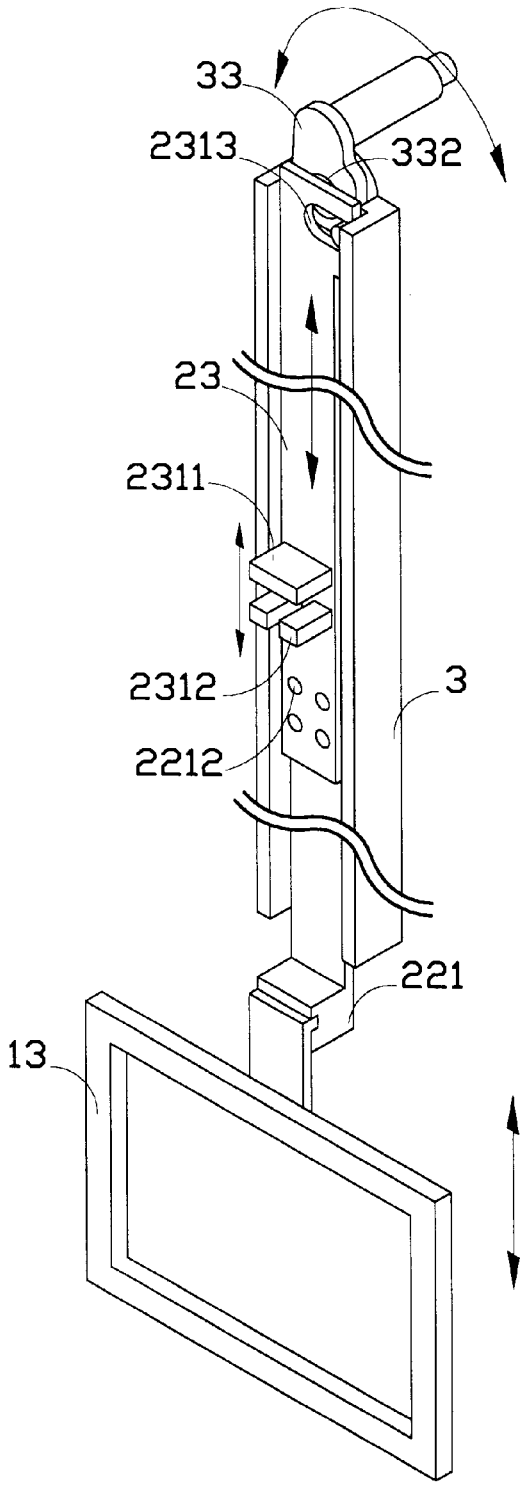
FIG. 8 is a view of the invention in action (3).

As illustrated in FIG. 8, when the inner slide block move up and down in the first step slide rail (1211), the male hook (131) is engaged to the hook groove (2211) of the low rod (22), the jutting keys (2212) of the low rod (22) are joined to the through holes (231) of the high rod (23), and the turning block (332) of the moving block (33) is engaged in the transverse groove hole (2313) on the high rod (23), so when the inner slide block (13) is sliding up and down, the transverse groove hole (2313) on the high rod (23) will push the turning block (332) of the moving block (33) to sway the moving block (33).

Figure 9:
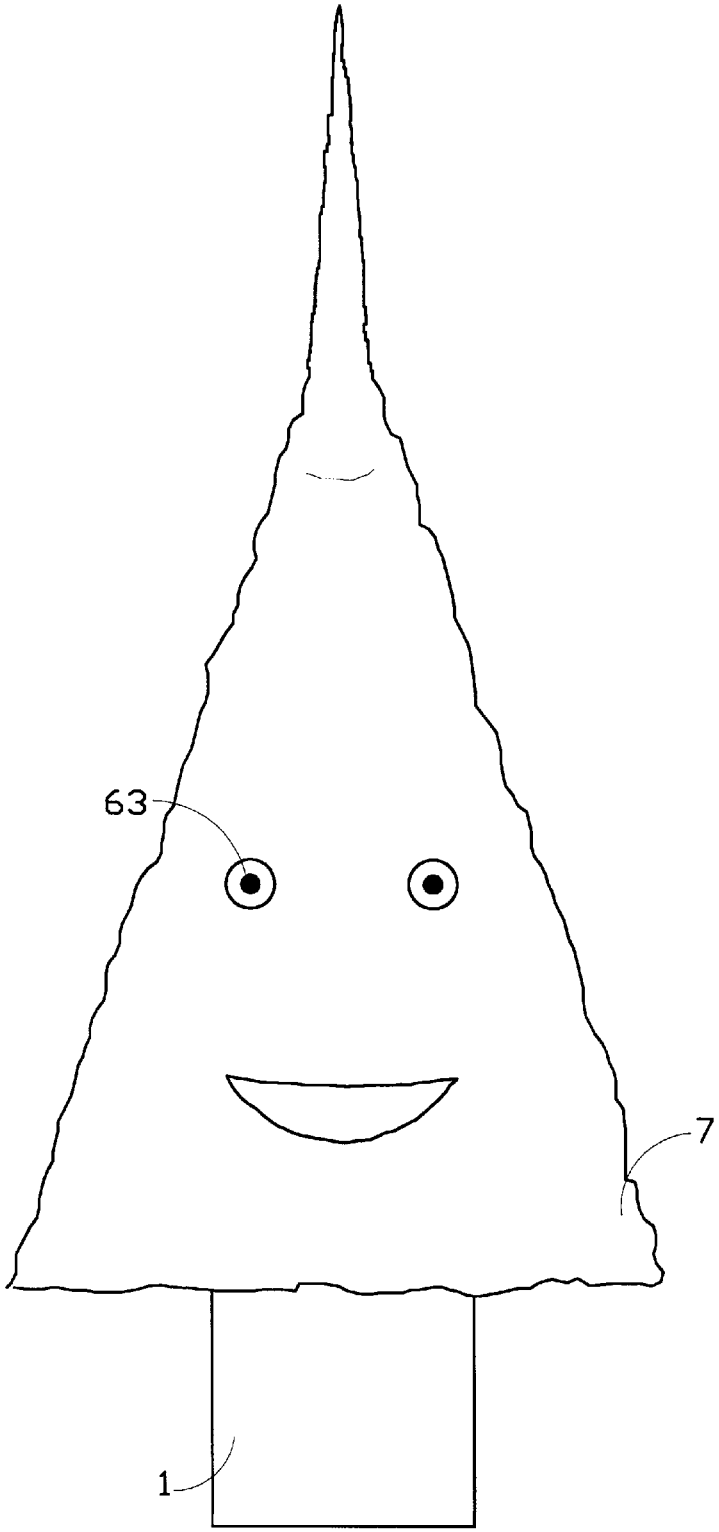
FIG. 9 is an embodiment view of the invention.

As illustrated in FIG. 9, a camouflage part (7) is coated on the outside of this invention, to cover almost all of the construction of the invention, so that purchasers will only see its exterior appearance.

Summing up, this invention is capable of achieving the objectives stated above, practical and industrially applicable, and has not been displayed in public before the subject application is filed, so in accordance with the provisions of the Patent Law, this application is filed for a patent right.

The above description covering only the preferred embodiment of the invention shall not be based to restrict or limit the scope of applications of the invention. All equivalent variations or modifications deriving from the subject description shall be included in the intent of the subject claims.

I claim:

1. A movable face toy mechanism, comprising a foundation, a connecting rod set, a U-shaped support, a cover plate, a mouth movement assembly and an eye movement assembly, wherein:

on the foundation being a gear box, next to and protruding from the gear box being a transmission shaft involving two guide levers, on said two guide levers corresponding to an inner and an outer slide blocks being a first step slide rail, on the inner slide block being a protruded male hook, an overlapped round cam being fixed to the transmission shaft, so designed that when the overlapped round cam is rotating, the inner and outer slide blocks will smoothly move up and down independently in the first step slide rail;

at an appropriate location on a short rod of the connecting rod set being a jaw pushing rod, on a connector of a low rod corresponding to the male hook of the inner slide block being a hook groove, at a top of the low rod being no less than two jutting keys, on a high rod corresponding to the jutting keys on the low rod being a same number of through holes, and at appropriate locations on the high rod being two eye pushing rods arranged vertically and a transverse groove hole;

on two arms of the U-shaped support being a corresponding second step slide groove, said second step slide groove enabling the low rod and the high rod to slide up and down, on a top of the U-shaped support being a round protrusion to match a shaft hole of a moving block, beside the shaft hole of the moving block being an eccentric turning block to match the transverse groove hole on the high rod;

on the cover plate and corresponding to the jaw pushing rod and the eye pushing rods being respectively a jaw pushing rod operating slot and an eye pushing rod operating slot;

on a jaw of the mouth movement assembly being a C-shaped hole, said C-shaped hole enabling the jaw to extend a hook plate, and the jaw extending backwards to form a jaw protrusion, a jaw turning shaft hole inside a jaw box supporting a jaw turning shaft of the jaw protrusion, a jaw moving rod of the jaw protrusion penetrating the jaw box to be positioned on the jaw pushing rod on the short rod in the connecting rod set, inside the jaw box being a fixing bolt, two ends of a fixing spring respectively keeping the hook plate in the C-shaped hole and the fixing bolt of the jaw box engaged;

on an inside of each of a left eye cap and a right eye cap in the eye movement assembly and opposite each other being symmetrically arranged an eye fixing hole and an eye cap shaft block, depressed in the eye cap shaft block of both the left eye cap and the right eye cap being a ring clasp groove, at opposite ends of the eye cap shaft block of each of the left eye cap and the right eye cap being symmetrically a shaft rod insert groove, on the eye fixing hole of the left eye cap and the right eye cap penetrating the left eye cap and the right eye cap being respectively an extension of a clasp part, an end of the clasp part clasping onto the clasp groove of the eye cap shaft block, fixed by the clasp part and an eye moving box, in the eye moving box being movably connected with a first fan gear and a second fan gear, the first fan gear being joined to a joining shaft groove of the eye moving box then extending backward to involve an eye moving rod, said eye moving rod is located between the eye pushing rods, the second fan gear involving a shaft cylinder extending out of an eye cap shaft hole, and on the shaft cylinder corresponding to a shaft rod being a shaft rod hole, the shaft rod will be connected by way of said shaft rod hole to the shaft rod insert groove of the left eye cap and the right eye cap;

the outer slide block in the foundation will be put to a bottom of the short rod, the male hook of the inner slide block will be engaged to the hook groove of the low rod, the cover plate will be covered onto the U-shaped support, then the connecting rod set will be fixed to the second step slide groove and the moving block of the U-shaped support, then the eye movement assembly and the mouth movement assembly will be fixed onto the cover plate.

* * * * *